United States Patent [19]

Lin

[11] Patent Number: 4,796,503

[45] Date of Patent: Jan. 10, 1989

[54] AMPLIFICATION CIRCUIT FOR ELECTRONIC TONE GENERATOR

[75] Inventor: Shyuh-Der Lin, Hsin-Chu, Taiwan

[73] Assignee: Industrial Technology Research Institute, Taiwan

[21] Appl. No.: 62,088

[22] Filed: Jun. 15, 1987

[51] Int. Cl.[4] ..... G10H 1/02; G10H 1/057

[52] U.S. Cl. ..... 84/1.26; 84/1.13

[58] Field of Search ..... 84/1.01, 1.13, 1.26, 84/DIG. 24, 1.22, 1.24; 340/384 E; 368/245; 307/261, 264, 268; 328/181, 187

[56] References Cited

U.S. PATENT DOCUMENTS

| | | | |
|---|---|---|---|
| 4,037,164 | 7/1977 | Pickton et al. | 84/1.13 X |
| 4,068,461 | 1/1978 | Fassett et al. | 58/23 R |
| 4,142,437 | 3/1979 | Kakehast | 84/1.24 |
| 4,183,020 | 1/1980 | Schade, Jr. | 340/384 E X |
| 4,213,367 | 7/1980 | Moog | 84/1.22 |
| 4,271,495 | 6/1981 | Scherzinger et al. | 84/1.26 X |
| 4,271,742 | 6/1981 | Sakashita et al. | 84/1.26 |
| 4,273,019 | 6/1981 | Goto | 84/1.24 |
| 4,296,663 | 10/1981 | Chibana | 84/1.01 |
| 4,382,251 | 5/1983 | Fujisawa | 84/DIG. 24 X |
| 4,386,856 | 6/1983 | Hakata | 368/245 X |
| 4,487,099 | 12/1984 | Ebihara | 84/1.26 |
| 4,545,279 | 10/1985 | Sano | 84/1.26 |
| 4,567,806 | 2/1986 | Kodaira | 84/1.26 |

*Primary Examiner*—Arthur T. Grimley
*Assistant Examiner*—John G. Smith
*Attorney, Agent, or Firm*—Cahill, Sutton & Thomas

[57] ABSTRACT

A shaped waveform tone generator circuit is contained entirely in an integrated circuit and has a pair of push-pull amplifiers for driving a piezo-buzzer. The output from an RC network controls current flow in a first follower transistor connected to one voltage source and in a second follower transistor connected to a second voltage source. A pair of CMOS switches alternately connect the inputs of the amplifiers to the first and second transistors. A tone signal controls operation of the two CMOS switches.

7 Claims, 1 Drawing Sheet

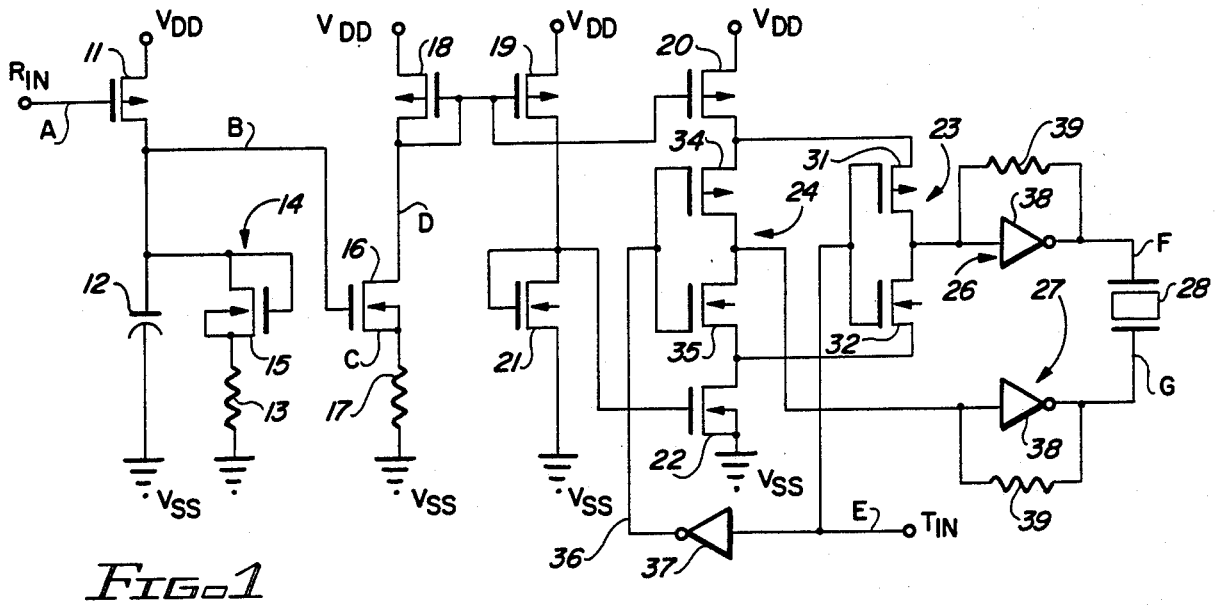
FIG. 1
FIG. 2
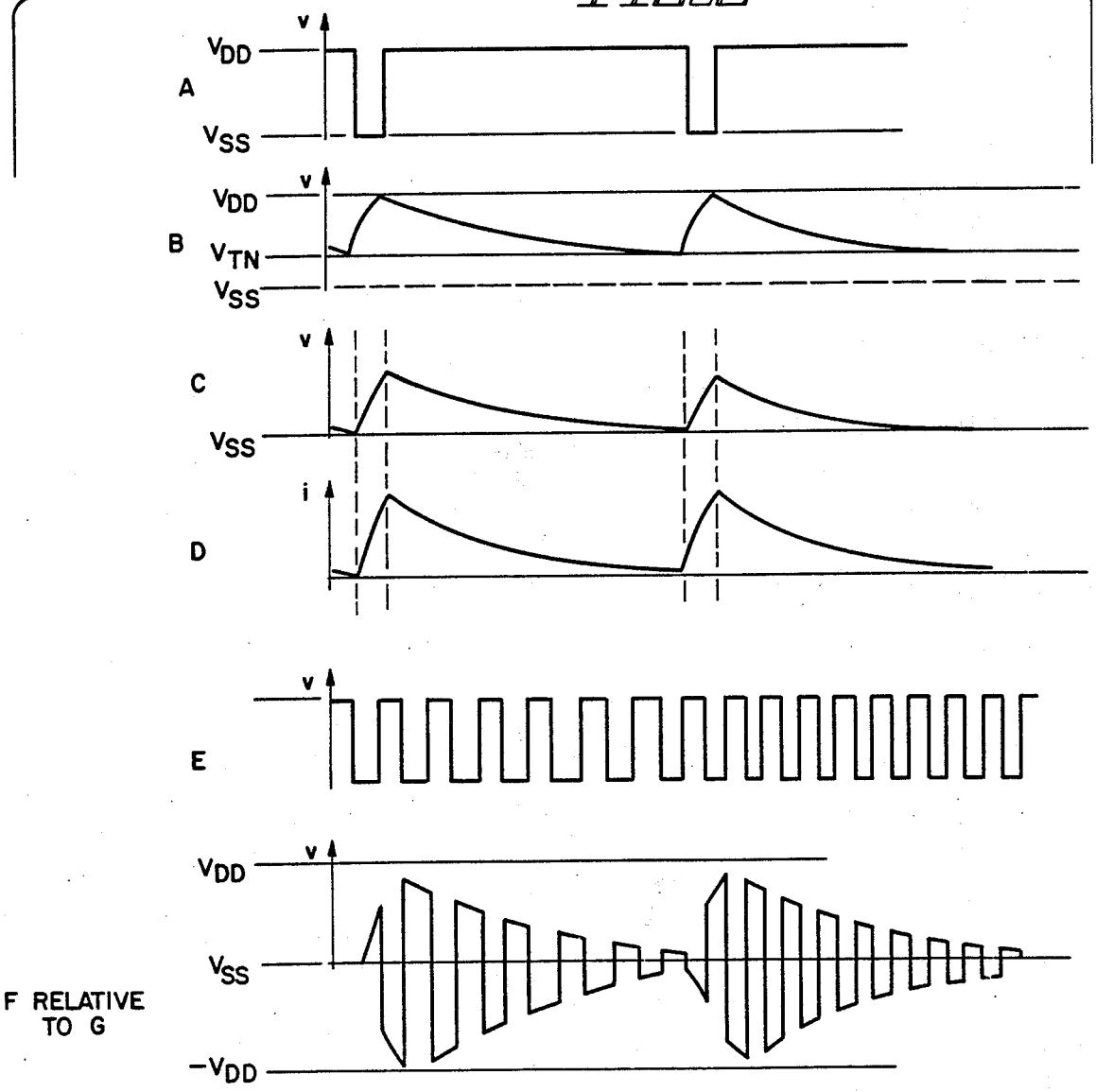

AMPLIFICATION CIRCUIT FOR ELECTRONIC TONE GENERATOR

TECHNICAL FIELD

This invention is concerned with tone generators, especially those for synthesizing music.

BACKGROUND ART

It has become fairly common practice in the design of electronic tone generators to employ resistor-capacitor circuits, or networks, (RC networks) to amplitude modulate the tone signals. The rapid charge of a capacitor and its subsequent discharge through a resistor produces a decaying voltage waveform similar to tones produced by musical instruments.

U.S. Pat. No. 4,273,019, granted June 16, 1981, to M. Goto for "Electronic Tone Generator" and U.S. Pat. No. 4,545,279, granted Oct. 8, 1985, to T. Sano for "Electronic Music Note Generator", disclose tone generators employing RC networks for shaping tone waveforms.

Various forms of electroacoustic devices have been employed to convert the shaped tone waveforms to audible sound.

Piezoelectric crystal devices, often called "piezo-buzzers", have proven themselves to be particularly capable of producing high quality musical tones similar to those produced by natural musical instruments.

Piezo-buzzers are a.c. voltage driven devices which must be isolated from any direct current signals in the tone generator circuitry. In the past this isolation has been accomplished by imposing a capacitor in the circuit to the piezo-buzzer. But the incorporation of a capacitor is not always practical in tone generators fabricated as an integrated circuit. And the use of integrated circuits is highly desirable for tone generators because of the low cost and reliability of the integrated circuits. Capacitors usually must be formed as distinct elements apart from the integrated circuit chips and the chip must be provided with bonding pads by which the capacitor is connected to the circuit. Such pads use up valuable space on the chip.

Other prior art tone generators utilizing logic techniques for forming the envelope of the tone signal have employed digital to analog converters to produce a waveformed current signal. This signal has been coupled to the piezo-buzzer through a tone signal input. Although no blocking capacitor is required for such a circuit, the digital to analog converter and logic circuitry greatly complicates the tone generator.

Because of the low voltage supply available for IC tone generators, usually of the order of three volts and rarely more than six volts, it is usually desirable to amplify the signal supplied to the piezo-buzzer. U.S. Pat. No. 4,567,806, granted Feb. 4, 1986 to M. Kodaira for "Sound Generator" and No. 4,487,099, granted Dec. 11, 1984 to H. Ebihara for "Electro-Acoustic Transducer Drive Circuit for Producing Damped Waveform Envelope Musical Notes", disclose the use of impedance coils for stepping up the signal voltage to the piezo-buzzer. Coils, like capacitors, are simply not economically compatible with integrated circuit devices.

Another circuit for amplifying a tone signal is disclosed in U.S. Pat. No. 4,068,461, granted Jan. 17, 1978 to J. R. Fassett, et al. for "Digital Electronic Alarm Watch". This patent discloses the use of MOS inverters to drive a piezoelectric device which produces a watch alarm signal. The patent contains no disclosure, however, of how such inverters might be utilized in a shaped waveform tone generator.

There continues to be a need for improved circuitry in a shaped waveform tone generator which provides push-pull amplification of tone signals imparted to a piezo-buzzer and which can be accomplished in a fully integrated circuit.

DISCLOSURE OF THE INVENTION

The output of a wave envelope signal from an RC network is fed to first and second current source transistors coupled respectively with high and low voltage sources of a power supply. Current having the waveform generated by the RC network flows in one direction through the first current sourcing transistor and in the opposite direction through the other current sourcing transistor.

An oscillating tone signal is introduced to the circuit and this signal has a voltage waveform corresponding to the frequency of the tone to be generated. This tone signal is fed to one CMOS switch connected to the first and second current sourcing transistors and to a first amplifier for the piezo-buzzer. The tone signal also is fed through an inverter to a second CMOS switch which is connected to the two current sourcing transistors and to a second amplifier for the piezo-buzzer. The arrangement is such that under control of the tone signal opposite oscillating current is supplied to the two amplifiers for the piezo-buzzer. In other words, when curent is flowing in the first amplifier an equal but opposite current is flowing in the second amplifier and vice versa. The two amplifiers convert this current flow to a positive and negative voltage signal for the piezo-buzzer which has twice the amplitude of the supply voltage, but shaped to the waveform produced by the RC network.

The circuit consists entirely of MOSFETs and resistors, i.e. it requires no condensers or induction coils and is, therefore, readily fabricated as an integrated circuit.

BRIEF DESCRIPTION OF THE DRAWINGS

The invention is described in greater detail hereinafter by reference to the accompanying drawings wherein:

FIG. 1 is a circuit diagram for an electronic tone generator embodying this invention; and FIG. 2 illustrates waveforms associated with the circuit of FIG. 1.

BEST MODE FOR CARRYING OUT THE INVENTION

Referring particularly to FIG. 1, initiation of generation of a tone by the circuit there illustrated is effected by imposition of a rhythm signal on terminal $R_{IN}$. That signal, which may have the waveform illustrated at A in FIG. 2, is conveyed to the gate of a P-channel MOSFET 11. Note that letter A in FIG. 1 identifies the location of the signal having the waveform A in FIG. 2. Other letters appearing in FIGS. 1 and 2 convey similar information.

The function of MOSFET 11 is to trigger initiation of a tone. It is connected to a voltage source $V_{DD}$ in series with a capacitor 12 and resistor 13. Capacitor 12 and resistor 13 are in parallel and are connected to a second voltage source $V_{SS}$, which may be ground. Transistor 11, capacitor 12 and resistor 13 comprise an RC network, generally indicated by reference numeral 14. When the gate of transistor 11 is subjected to a low voltage pulse (waveform A of FIG. 2) the transistor turns on, connecting capacitor. 12 to $V_{dd}$ for a brief period to rapidly charge the capacitor. When the gate of transistor 11 is returned to a higher voltage level the transistor turns off and the charge in capacitor 12 gradually leaks through resistor 13 to voltage source $V_{SS}$.

The RC network 14 employed in this invention also preferably comprises a diode connected N-channel MOSFET 15 connected in series with resistor 13. Transistor 15 serves to limit discharge of capacitor 12 to insure an output voltage from the RC network 14 at some level above $V_{SS}$. As the voltage impressed on the gate of transistor 15 approaches the threshold voltage $V_{TN}$ of the transistor 15 the transistor shuts off, inhibiting further discharge of capacitor 12.

The resulting voltage waveform from the RC network 14 at point B in the circuit appears as waveform B in FIG. 2. Waveform B is characterized by exhibiting rapidly increasing voltage during an attack portion while the capacitor 12 is being charged and an exponential decay portion while the capacitor 12 is discharging through resistor 13. The voltage in waveform B decreases only to $V_{TN}$ of transistor 15.

Voltage waveform B from the RC network 14 closely approximates the amplitude envelope of tones produced by musical instruments. And this output from the RC network is utilized, as has been done in prior art tone generators, to amplitude modulate a tone signal to synthesize a musical note. Unlike prior art tone generators, however, the RC network output signal in this invention is not employed directly to drive an electroacoustic output device, but rather is isolated therefrom by intermediate circuitry.

The isolating means, or circuit, includes a source follower N-channel MOSFET 16 having its gate connected to the output of RC network 14. Transistor 16 has its source connected to $V_{SS}$ through a resistor 17. Transistor 16 and resistor 17 together act as a level-shift and source follower with respect to voltage waveform B imposed on its gate from RC network 14. A downshift voltage waveform C in the image of waveform B is generated at the source of transistor 16. The resulting current flow through transistor 16 is that illustrated as waveform D. This current appears at location D in the circuit of FIG. 1 and flows through another diode connected, P-channel MOSFET 18 which is connected to voltage source $V_{DD}$.

A current corresponding to waveform D and flowing through transistor 18 initiates like currents in two other P-channel MOSFETs 19 and 20. Transistors 18, 19 and 20 are connected in parallel to $V_{DD}$ and have their gates connected. This connection establishes current mirrors in which the currents through transistors 19 and 20 are proportioned to the current flow through transistor 18. The currents in transistors 19 and 20 are, therefore, of the same waveform as that illustrated at D in FIG. 2. In other words, these currents have the same attack and decay characteristics as the output of RC network 14.

The circuitry thus far described, including particularly the isolating means provided by transistor 16 and the current mirrors between transistor 18 and transistors 19 and 20, is described and claimed in copending application for U.S. patent, Ser. No. 031,893, filed by Shyuh-Der Lin on Mar. 30, 1987, and assigned to the same assignee as this application. The circuitry hereinafter described originates with the invention which is the subject of the present application.

Transistor 19 is connected to a diode connected N-channel MOSFET 21 which, in turn, is connected to voltage source $V_{SS}$. Transistor 21 is also connected in current mirror relationship with an N-channel MOSFET 22. Transistors 21 and 22 have their gates connected so that the current flow through transistor 22 is proportional to the current flow through transistor 21.

It will be noted that transistors 20 and 22 are source followers with transistor 20 receiving sourcing current from $V_{DD}$ and transistor carrying sinking current to $V_{SS}$. Thus, while the currents flowing through both transistors 20 and 22 have similarly shaped waveforms, like that generated by RC network 14, the current flow through transistor 22 is opposite the current flow through transistor 20. These waveforms constitute amplitude envelopes which are imposed upon and shape the amplitude of a tone signal which is introduced into the generator at terminal $T_{IN}$.

Tone signal at $T_{IN}$ has a waveform such as that shown as waveform E in FIG. 2. The frequency of the tone signal at $T_{IN}$ corresponds to the frequency of the tone, or note, to be produced by the generator. A memory, (not shown), supplying the signal to $T_{IN}$ is programmed to produce different frequency tone signals for different notes of the music to provide a melody.

Tone signal at $T_{IN}$ is combined with the waveform currents flowing through transisors 20 and 22 by CMOS switches 23 and 24. The combined, or amplitude shaped, tone signals are transmitted to a pair of push-pull amplifiers 26 and 27 which convert the current signals to a.c. voltage signals which drive a piezo-buzzer 28 to produce the desired tone.

CMOS switch 23 consists of a complementary pair of MOSFETs 31 and 32. Transistor 31 is a P-channel and is connected between source follower transistor 20 and amplifier 26. Transistor 32 is N-channel and is connected between sinking follower transistor 22 and amplifier 26. The gates of transistors 31 and 32 are connected in parallel and receive the oscillating tone signal from $T_{IN}$.

The tone signal imparted to the gates of transistors 31 and 32 oscillates between $V_{DD}$ and $V_{SS}$, as shown in waveform E in FIG. 2. This voltage signal passes through the threshold voltage of each of the complementary transistors so that transistor 31 turns off when transistor 32 turns on and vice versa. As a result, CMOS switch 23 alternately connects amplifier 26 with follower transistor 20 and follower transistor 22. These alternating connections are made at the frequency of the tone signal and the amplitude of the signal supplied to amplifier 26 is shaped by, or confined to the envelope of, the opposite current waveforms in transistors 20 and 22.

CMOS switch 24 performs a similar function with respect to the other amplifier 27. Switch 24 consists of a complementary pair of MOSFETs 34 and 35 which are connected, respectively, between follower transistor 20 and amplifier 27 and between follower transistor 22 and amplifier 27. The gates of transistor 34 and 35 are in parallel and are connected via a lead 36 to tone signal input $T_{IN}$. Lead 36 also includes an inverter 37.

CMOS switch 24 is thus able to alternately connect amplifier 27 to follower transistor 20 and follower transistor 22. Because the portion of the tone signal supplied to CMOS switch 24 goes through inverter 37 the signal supplied thereto is the opposite, or the complement of, the tone signal supplied to the other CMOS switch 23.

This circuitry is such that when switch 23 connects amplifier 26 to follower transistor 20, switch 24 connects amplifier 27 to follower transistor 22. When amplifier 26 is connected to transistor 22, amplifier 27 is connected to transister 20. Because the current flow in transistor 20 and 22 are opposite, the current flows to amplifiers 26 and 27 are alternately reversed.

Each amplifier, 26 and 27, consists of a CMOS inverter 38 and a bias resistor 39 which sets the amplifier in the active range. The output of each amplifier 26 and 27 is a voltage signal, with no direct current component, which varies in frequency corresponding to the current flowing in transistors 20 and 22, i.e. the waveform produced by RC network 14.

Because of the push-pull, complementary output from amplifiers 26 and 27 the voltage waveform imposed on piezo-buzzer 28 varies from $V_{DD}$ to the equivalent of $-V_{DD}$. This waveform is illustrated in FIG. 2 as the voltage at point F relative to the voltage of point G in FIG. 1. This push-pull amplification substantially doubles the volume of the tones emitted by the piezo-buzzer 28.

It is to be noted that because there is no direct current component to the signals from amplifiers 26 and 27 to the piezo-buzzer it is not necessary to include a blocking condenser ahead of the piezo-buzzer. This elimates low-frequency distortion which can be caused by such a capacitor and enables the generator to produce more realistic and pleasant tones. Also, as mentioned previously, elimination of a capacitor simplifies and reduces the cost of construction of the intergrated circuit.

It further will be noted that push-pull amplification from amplifiers 26 and 27 is achieved without the necessity of cascading the amplifiers, as has been required in some prior art circuits. In those prior circuits any deviation from linearity in the first amplifier was further distorted by the second amplifier and degraded the quality of the output tones. The circuit of this invention produces improved tones.

Finally, as previously noted, the circuit of this invention consists entirely of MOSFETs and resistors and, therefore, is readily fabricated as an integrated circuit.

What is claimed is:

1. In an electronic tone generator, first and second source follower transistors connected, respectively, to two different voltage sources, means including an RC network for producing waveform shaped currents in said follower transistors, first and second switch means, first and second amplifiers having inputs and outputs, a piezo-buzzer connected to the outputs of said amplifiers, said first switch means being capable of alternately connecting the input of said first amplifier to said first follower transistor and to said second follower transistor, said second switch means being capable of alternately connecting the input of said second amplifier to said first follower transistor and to second follower transistor, and means for imparting a tone signal to said first and second switch means.

2. The tone generator of claim 1 further characterized in that the tone signal imparted to said second switch means is inverted with respect to the tone signal imparted to said first switch means.

3. The tone generator of claim 2 further characterized in that first and second follower transistors are MOSFETS.

4. The tone generator of claim 3 further characterized in that said first and second switch means are comprised of CMOS transistors.

5. The tone generator of claim 4 further characterized in that said amplifiers comprise biased CMOS inverters.

6. The tone generator of claim 5 further characterized in that the means for imparting an inverted tone signal to said second switch means includes a CMOS inverter.

7. The tone generator of claim 6 further characterized in that all of the components with the exception of the piezo-buzzer are contained in a single integrated circuit chip.

* * * * *